US011655513B2

(12) United States Patent
Zhan

(10) Patent No.: US 11,655,513 B2
(45) Date of Patent: May 23, 2023

(54) METHODS OF FORMING MAGNESIUM-BASED ALLOY ARTICLES AT HIGH STRAIN RATES

(71) Applicant: GM GLOBAL TECHNOLOGY OPERATIONS LLC, Detroit, MI (US)

(72) Inventor: Henry Zhan, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 148 days.

(21) Appl. No.: 17/117,254

(22) Filed: Dec. 10, 2020

(65) Prior Publication Data

US 2021/0172035 A1 Jun. 10, 2021

(30) Foreign Application Priority Data

Dec. 10, 2019 (CN) ..... 201911258850.0

(51) Int. Cl.
*C21D 8/02* (2006.01)
*C22C 23/04* (2006.01)
(Continued)

(52) U.S. Cl.
CPC ..... *C21D 8/0236* (2013.01); *C21D 9/32* (2013.01); *C21D 9/40* (2013.01); *C22C 23/04* (2013.01); *C22F 1/06* (2013.01)

(58) Field of Classification Search
CPC ..... C22F 1/06
See application file for complete search history.

(56) References Cited

U.S. PATENT DOCUMENTS 8,357,250 B2 1/2013 Krajewski et al.
9,920,402 B2 3/2018 Lyon
(Continued)

FOREIGN PATENT DOCUMENTS

CN 102892909 A 1/2013
CN 107427603 A 12/2017
(Continued)

OTHER PUBLICATIONS

First Office Action for Chinese Patent Application No. 201911258850.0 dated Dec. 16, 2021, with correspondence dated Dec. 20, 2021, from China Patent Agent (H.K.) Ltd. summarizing contents; 11 pages.

(Continued)

*Primary Examiner* — Anthony J Zimmer
*Assistant Examiner* — Sean P. O'Keefe
(74) *Attorney, Agent, or Firm* — Harness, Dickey & Pierce, P.L.C.

(57) ABSTRACT

Methods of making magnesium-based alloy components, such as automotive components, include treating a casting comprising a magnesium-based alloy to a first deforming process to form a preform. In one aspect, the first deforming process has a first maximum predetermined strain rate of greater than or equal to about 0.001/s to less than or equal to about 1/s in an environment having a temperature of ≥to about 250° C. to ≤to about 450° C. In another aspect, the first deforming process is cold deforming that is followed by annealing. The preform is then subjected to a second deforming process having a second maximum predetermined strain rate of ≥about 1/s to ≤about 100/s in an environment having a temperature of ≥about 150° C. to ≤about 450° C. to form the magnesium-based alloy component substantially free of cracking. A solid magnesium-based alloy component having select microstructures are also provided.

20 Claims, 3 Drawing Sheets

(51) Int. Cl.

| | |
|---|---|
| ***C22F 1/06*** | (2006.01) |
| ***C21D 9/32*** | (2006.01) |
| ***C21D 9/40*** | (2006.01) |

(56) References Cited

U.S. PATENT DOCUMENTS

| | | | | |
|---|---|---|---|---|
| 10,589,005 | B2 | 3/2020 | Edick et al. | |
| 2005/0194072 | A1 | 9/2005 | Luo et al. | |
| 2006/0130947 | A1* | 6/2006 | Oishi | C22F 1/06 148/420 |
| 2008/0138640 | A1* | 6/2008 | Nishikawa | C22C 23/04 164/476 |
| 2010/0096046 | A1 | 4/2010 | Krajewski et al. | |
| 2011/0286880 | A1* | 11/2011 | Luo | C22C 23/02 420/407 |
| 2012/0305145 | A1* | 12/2012 | Decker | C22F 1/08 148/400 |
| 2014/0200652 | A1* | 7/2014 | Bayer | C23G 1/12 420/407 |
| 2016/0263288 | A1* | 9/2016 | Edick | A61F 2/04 |

FOREIGN PATENT DOCUMENTS

| | | | | |
|---|---|---|---|---|
| CN | 112941435 | A | 6/2021 | |
| DE | 102020129422 | A1 | 6/2021 | |
| JP | 2000246414 | A | 9/2000 | |
| JP | 4632949 | B2 * | 2/2011 | C22F 1/06 |

OTHER PUBLICATIONS

Khan, Akhtar S. et al.; "Mechanical response and texture evolution of AZ31 alloy at large strains for different strain rates and temperatures"; International Journal of Plasticity 27 (2011) pp. 688-706.

Second Office Action for Chinese Patent Application No. 201911258850.0 dated Jul. 4, 2022, with correspondence dated Jul. 6, 2022, from China Patent Agent (H.K.) Ltd. summarizing contents; 6 pages.

* cited by examiner

METHODS OF FORMING MAGNESIUM-BASED ALLOY ARTICLES AT HIGH STRAIN RATES

CROSS-REFERENCE TO RELATED APPLICATIONS

This application claims the benefit and priority of Chinese Patent Application No. 201911258850.0 filed Dec. 10, 2019. The entire disclosure of the above application is incorporated herein by reference.

INTRODUCTION

This section provides background information related to the present disclosure which is not necessarily prior art.

The present disclosure relates to methods of making magnesium-based alloy components, such as automotive components, by treating a magnesium-based alloy to a first deforming process to create a preform that may then be subjected to a high strain rate while avoiding cracking.

Lightweight metal components have become an important focus for manufacturing vehicles, especially automobiles, where continual improvement in performance and fuel efficiency is desirable. While conventional steel and other metal alloys provide various performance benefits, including high strength, such materials can be heavy. Lightweight metal components for automotive applications are often made of aluminum and/or magnesium alloys. Such lightweight metals can form load-bearing components that are strong and stiff, while having good strength and ductility (e.g., elongation). High strength and ductility are particularly important for safety requirements and durability in vehicles like automobiles.

While magnesium-containing alloys are an example of lightweight metals that can be used to form structural components in a vehicle, in practice, the use of magnesium-containing alloys may be limited. While aluminum-containing alloys can be treated by a variety of different formation techniques, including those that involve high strain rates, like wrought processes such as extrusion, rolling, forging, flow forming, stamping, and the like, magnesium-based alloys are typically limited to processes that only experience low strain rates (e.g., less than 1/second) or else they may crack. It would be desirable to be able to form components for vehicles formed of materials comprising magnesium via a variety of high-strain rate processes. Thus, there is an ongoing need for improved formation processes to form improved lightweight metal components from magnesium-containing alloys.

SUMMARY

This section provides a general summary of the disclosure and is not a comprehensive disclosure of its full scope or all of its features.

The present disclosure relates to a method of making a magnesium-based alloy component. The method may include treating a casting including a magnesium-based alloy to a first deforming process. The first deforming process has a first maximum predetermined strain rate of greater than or equal to about 0.001/s to less than or equal to about 1/s. The first deforming process is conducted in an environment having a temperature of greater than or equal to about 250° C. to less than or equal to about 450° C. to form a preform. The magnesium-based alloy has a composition including zirconium at greater than or equal to 0 to less than or equal to about 1 wt. %; manganese at greater than or equal to about 0.3 wt. % to less than or equal to about 2 wt. %; scandium at greater than or equal to 0 to less than or equal to about 15 wt. %; a rare earth metal element at greater than or equal to 0 to less than or equal to about 20 wt. %; zinc at greater than or equal to 0 to less than or equal to about 6 wt. %; aluminum at greater than or equal to 0 to less than or equal to about 3 wt. %; and a balance of magnesium. The method also includes subjecting the preform to a second deforming process having a second maximum predetermined strain rate of greater than or equal to about 1/s to less than or equal to about 100/s. The second deforming process is conducted in an environment having a temperature of greater than or equal to about 150° C. to less than or equal to about 450° C. to form the magnesium-based alloy component substantially free of cracking.

In one aspect, the preform includes one or more intermetallic species selected from the group consisting of: ZnZr, AlMn, MnSc, AlRE, where RE is a rare earth element, and combinations thereof.

In one aspect, the first deforming process is selected from the group consisting of: extrusion, forging, rolling, and combinations thereof.

In one aspect, the second deforming process is selected from the group consisting of: high-speed rolling, flow forming, high-speed forging, ring rolling, and combinations thereof.

In one aspect, prior to the treating, the method further includes heat-treating the casting to homogenize the magnesium-based alloy, form thermally-stable refined precipitates, or both homogenize the magnesium-based alloy and form thermally-stable refined precipitates.

In one aspect, the preform includes a matrix including a plurality of dynamically recrystallized grains having an average size of greater than or equal to about 0.1 μm to less than or equal to about 20 μm and a plurality of coarse grains having an average size of greater than or equal to about 1 μm to less than or equal to about 200 μm. An average size of the plurality of coarse grains is greater than or equal to 50% more than the average size of the dynamically recrystallized grains.

In one aspect, the magnesium-based alloy includes a plurality of domains including thermally stable refined intermetallic species distributed in a matrix. The matrix undergoes dynamic recrystallization during the treating to form refined grains, while dynamic recrystallization in the plurality of domains is minimized or prevented.

In one aspect, the method further includes a heat treatment after the subjecting in an environment having a temperature of greater than or equal to about 150° C. to less than or equal to about 300° C. for a duration of greater than or equal to about 2 hours to less than or equal to about 100 hours to enhance mechanical properties of the magnesium-based alloy component.

In one aspect, the magnesium-based alloy component is an automotive component selected from the group consisting of: an internal combustion engine component, a valve, a piston, a turbocharger component, a rim, a wheel, a ring, and combinations thereof.

The present disclosure also relates to a method of making a magnesium-based alloy component. The method may include treating a casting including a magnesium-based alloy to a cold deforming process in an environment having a temperature of less than or equal to about 200° C. to form a preform. The magnesium-based alloy has a composition including zirconium at greater than or equal to 0 to less than or equal to about 1 wt. %; manganese at greater than or equal to about 0.3 wt. % to less than or equal to about 2 wt. %; scandium at greater than or equal to 0 to less than or equal to about 15 wt. %; a rare earth metal element at greater than or equal to 0 to less than or equal to about 20 wt. %; zinc at greater than or equal to 0 to less than or equal to about 6 wt. %; aluminum at greater than or equal to 0 to less than or equal to about 3 wt. %; and a balance of magnesium. The method may also include annealing the preform. Further, the preform may be subjected to a second deforming process having a maximum predetermined strain rate of greater than or equal to about 1/s to less than or equal to about 100/s in an environment having a temperature of greater than or equal to about 150° C. to less than or equal to about 450° C. This forms the magnesium-based alloy component that is substantially free of cracking.

In one aspect, the second deforming process is selected from the group consisting of: high-speed rolling, flow forming, high-speed forging, ring rolling and combinations thereof.

In one aspect, prior to the treating, the method further includes heat treating the casting to homogenize the magnesium-based alloy, form thermally-stable refined precipitates, or both homogenize the magnesium-based alloy and form thermally-stable refined precipitates.

In one aspect, the magnesium-based alloy includes a plurality of domains including thermally stable refined precipitates distributed in a matrix. The matrix undergoes static recrystallization during the treating to form refined grains, while static recrystallization in the plurality of domains is minimized or prevented.

In one aspect, the method further includes a heat treatment after the subjecting in an environment having a temperature of greater than or equal to about 150° C. to less than or equal to about 300° C. for a duration of greater than or equal to about 2 hours to less than or equal to about 100 hours to enhance mechanical properties of the magnesium-based alloy component.

In one aspect, after the annealing, the preform includes one or more intermetallic species selected from the group consisting of: ZnZr, AlMn, MnSc, AlRE, where RE is a rare earth element, and combinations thereof.

In one aspect, the magnesium-based alloy component is an automotive component selected from the group consisting of: an internal combustion engine component, a valve, a piston, a turbocharger component, a rim, a wheel, a ring, and combinations thereof.

The present disclosure also relates to a solid magnesium-based alloy component. The component includes a microstructure with greater than or equal to about 5% by area to less than or equal to about 50% by area of elongated thermally stable grains including an intermetallic species having an average size of greater than or equal to about 1 nm to less than or equal to about 1 μm. The elongated thermally stable grains are distributed in a matrix including recrystallized grains having an average size of greater than or equal to about 0.1 μm to less than or equal to about 20 μm. The solid magnesium-based alloy component is substantially free of cracking.

In one aspect, the recrystallized grains in the matrix are dynamically recrystallized grains.

In one aspect, the microstructure is formed from a magnesium-based alloy including zirconium at greater than or equal to 0 to less than or equal to about 1 wt. %; manganese at greater than or equal to about 0.3 wt. % to less than or equal to about 2 wt. %; scandium at greater than or equal to 0 to less than or equal to about 15 wt. %; a rare earth metal element at greater than or equal to 0 to less than or equal to about 20 wt. %; zinc at greater than or equal to 0 to less than or equal to about 6 wt. %; aluminum at greater than or equal to 0 to less than or equal to about 3 wt. %; and a balance of magnesium.

In one aspect, the intermetallic species is selected from the group consisting of: ZnZr, AlMn, MnSc, AlRE, where RE is a rare earth element, and combinations thereof.

In one aspect, the solid magnesium-based alloy component is an automotive component selected from the group consisting of: an internal combustion engine component, a valve, a piston, a turbocharger component, a rim, a wheel, a ring and combinations thereof.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
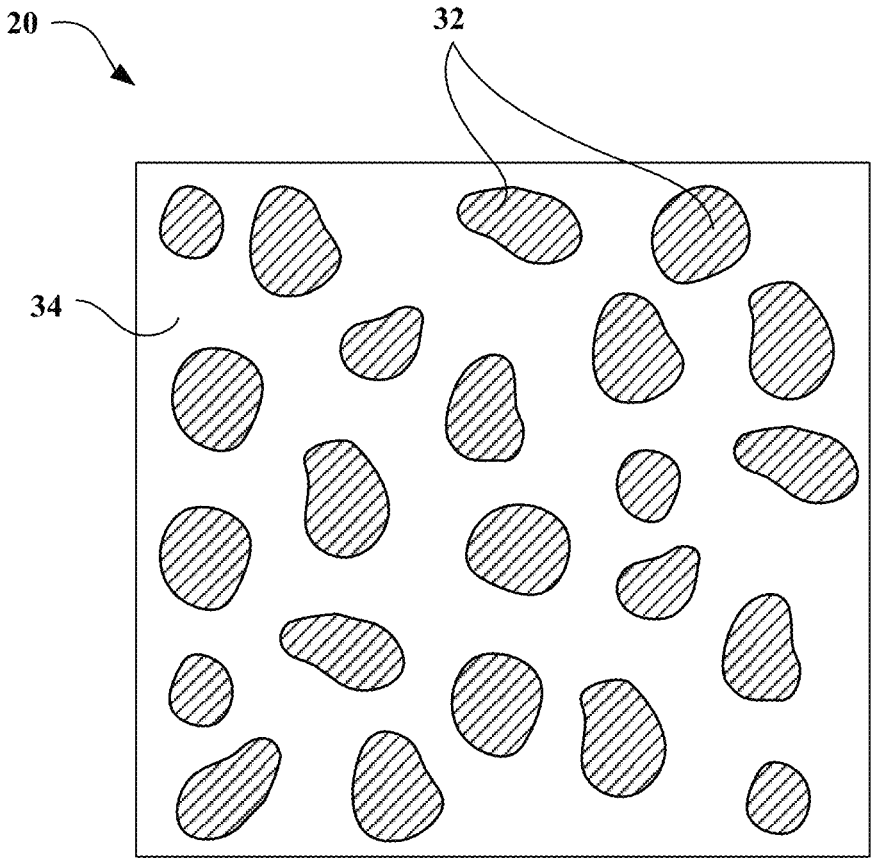
FIG. 1 shows a representative schematic of a preform of a magnesium-based alloy preform created in accordance with certain aspects of the present disclosure including a plurality of thermally stable coarse grains distributed in a matrix of refined grains.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer or section. Terms such as "first," "second," and other numerical terms when used herein do not imply a sequence or order unless clearly indicated by the context. Thus, a first step, element, component, region, layer or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

In certain aspects, the present disclosure pertains to methods of making magnesium-based alloy components. The methods provided herein enable the formation of components comprising magnesium-based alloys at high strain rates by first forming a preform that is tailored to have a predetermined microstructure that is subsequently subjected to high strain rates, which is beneficial for mechanical properties of the formed from magnesium-based alloy components. Generally, magnesium-based alloys display anisotropic behavior during deformation and working, which can limit the options available for processing. The anisotropic behavior can occur at least in part during forming of the desired shape of the articles at high-strain rates. Due to strong geometrical softening effects in magnesium-based alloys, strain localization tends to occur in domains with softer orientations during high-strain rate deformations, which can lead to severe cracking at early formation stages. Thus, magnesium-based alloys generally cannot be formed without cracking in manufacturing processes that involve high-strain rates.

Strain is generally understood to be a ratio of two lengths (initial and final) and thus a dimensionless value. Thus, a strain rate is in units of inverse time (such as $s^{-1}$). A high strain rate process may be considered to be one that applies a strain rate of greater than or equal to about 1/s to a material as it is being processed. High strain rate forming processes may include those processes selected from the group consisting of: high-speed rolling, flow forming, high-speed forging, ring rolling and combinations thereof. However, conventionally such high strain rate processes have been avoided when forming articles or components from magnesium-based alloys due to extensive cracking that occurs.

In accordance with certain aspects of the present disclosure, certain magnesium-based alloys may be treated to form an advantageous microstructure in a preform that can subsequently be subjected to high strain rate processes without suffering from significant cracking. Suitable magnesium-based alloys have a composition comprising zirconium (Zr) at greater than or equal to 0 to less than or equal to about 1 wt. %. Manganese (Mn) may be present at greater than or equal to about 0.3 wt. % to less than or equal to about 2 wt. %. Scandium (Sc) may be present at greater than or equal to 0 to less than or equal to about 15 wt. %. The magnesium-based alloy may also include an optional additional rare earth metal (RE) element (in addition to or in lieu of scandium) present at greater than or equal to 0 to less than or equal to about 20 wt. %. The rare earth metal may be a lanthanide. In certain aspects, the additional rare earth element is selected from the group consisting of: cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), terbium (Tb), thulium (Tm), ytterbium (Yb), yttrium (Y), and combinations thereof. In certain variations, the additional rare earth element is selected from the group consisting of: cerium (Ce), gadolinium (Gd), neodymium (Nd), scandium (Sc), yttrium (Y), and combinations thereof. In certain variations, the rare earth element may include a combination of rare earth elements, such as neodymium, with the remainder being heavy rare earths, such as ytterbium, erbium, dysprosium and/or gadolinium. The magnesium-based alloy also comprises zinc (Zn) at greater than or equal to 0 to less than or equal to about 6 wt. %. Aluminum (Al) may be present at greater than or equal to 0 to less than or equal to about 3 wt. %. Impurities may be present at less than or equal to about 0.1 wt. %, optionally less than or equal to about 0.05 wt. %, and in certain variations, optionally less than or equal to about 0.01 wt. % of the magnesium-based alloy. A balance of the magnesium-based alloy may be magnesium (Mg).

In one variation, the magnesium-based alloy may be a ZK30 alloy, nominally having 3 wt. % zinc, 0.5-0.6 wt. % zirconium, and a balance magnesium. In another variation, the magnesium-based alloy may be a ZK60 alloy nominally having 6 wt. % zinc, 0.5-0.6 wt. % zirconium, and a balance magnesium. In yet other variations, the magnesium-based alloy may nominally have 1 wt. % aluminum, 0.5 wt. % zinc, and 0.5 wt. % manganese, and a balance magnesium.

In certain variations, the magnesium-based alloy may have a composition consisting essentially of zirconium (Zr) at greater than or equal to 0 to less than or equal to about 1 wt. %; manganese (Mn) at greater than or equal to about 0.3 wt. % to less than or equal to about 2 wt. %; scandium (Sc) at greater than or equal to 0 to less than or equal to about 15 wt. %; an additional rare earth metal (RE) element at greater than or equal to 0 to less than or equal to about 2 wt. %, as discussed above. The magnesium-based alloy also consists essentially of zinc (Zn) at greater than or equal to 0 to less than or equal to about 6 wt. %; aluminum (Al) at greater than or equal to 0 to less than or equal to about 3 wt. %; impurities at less than or equal to about 0.1 wt. %; and a balance of magnesium (Mg).

In yet other variations, the magnesium-based alloy may have a composition consisting of zirconium (Zr) at greater than or equal to 0 to less than or equal to about 1 wt. %; manganese (Mn) at greater than or equal to about 0.3 wt. % to less than or equal to about 2 wt. %; scandium (Sc) at greater than or equal to 0 to less than or equal to about 15 wt. %; an additional rare earth metal (RE) element at greater than or equal to 0 to less than or equal to about 2 wt. %, as discussed above. The magnesium-based alloy also consists of zinc (Zn) at greater than or equal to 0 to less than or equal to about 6 wt. %; aluminum (Al) at greater than or equal to 0 to less than or equal to about 3 wt. %; other impurities at less than or equal to about 0.1 wt. %; and a balance of magnesium (Mg).

Such magnesium alloys have the capability of forming thermally stable precipitates or intermetallic species during pre-deformation heat treatment and/or during the processing step(s) at intermediate strain rates described here to provide a preform. In certain aspects, the intermetallic species may have a composition selected from the group consisting of: ZnZr, MnSc, AlMn, AlRE, where RE is a rare earth element that may include any of those described above, including scandium, and combinations thereof. The thermally stable precipitates are located in coarse grains that are distributed in a matrix of the magnesium-based alloy and can remain stable during higher temperature processing, for example, at temperatures of greater than or equal to about 200° C. Thermally stable refined precipitates can pin dislocations and retard dynamic recrystallization (DRX) during any intermediate treating or processing steps that are contemplated herein. Thus, the microstructures formed during certain methods of treatment provided by the present disclosure form domains that ultimately are resistant to dynamic recrystallization (or alternatively static recrystallization). These domains are thus rich in thermally stable precipitates and after undergoing high strain processing, are embedded in a matrix of dynamically recrystallized grains or domains that are lean in the thermally stable precipitates. In this manner, the present disclosure contemplates forming tailored bimodal microstructures to enable high-strain-rate deformation processing. In such microstructures, strain localization induced by geometrical softening is impeded by grain size inhomogeneity.

In certain variations, the present disclosure provides a method of treating a casting (e.g., billet, slab, cast-to-size article, and the like) formed of a magnesium-based alloy, like those described above, which include coarse grains comprising thermally stable precipitates/intermetallic species. The treating includes a first deforming process. The first deforming process has an intermediate strain rate level, for example, having a maximum first predetermined strain rate of greater than or equal to about 0.001/s to less than or equal to about 1/s. Notably, in the actual manufacturing process, the strain rate experienced by different part of work piece may vary and may not be constant during the entire process. The first deforming process that creates the preform may be conducted in an environment having a temperature of greater than or equal to about 250° C. to less than or equal to about 450° C., optionally greater than or equal to about 350° C. to less than or equal to about 400° C. In certain aspects, the first deforming process that creates the preform is selected from the group consisting of: extrusion, forging, rolling, and combinations thereof. By controlling strain rate, temperature and strain level during the intermediate processing step/first deforming process, bimodal microstructures can be obtained in a preform comprising the magnesium-based alloy. In certain aspects, the intermediate processing step/first deforming process may have a strain level of greater than or equal to about 20% to less than or equal to about 300%. In one variation, Gleeable mechanical testing can be used as a lab-scale technique to simulate intermediate processing conditions and determine suitable processing windows for forming the preform.

As shown in a preform microstructure 20 in FIG. 1, after the preform is treated by the first deforming process, the magnesium-based alloy optionally comprises a plurality of domains 32 comprising thermally stable refined precipitates distributed in a matrix 34. Generally, the plurality of domains 32 are rich in intermetallic species or precipitates, meaning that of a total concentration of the intermetallic species present in the composition, greater than 50% by weight, optionally greater than or equal to about 55% by weight, optionally greater than or equal to about 60% by weight, optionally greater than or equal to about 65% by weight, optionally greater than or equal to about 70% by weight, optionally greater than or equal to about 75% by weight, optionally greater than or equal to about 80% by weight, optionally greater than or equal to about 85% by weight, optionally greater than or equal to about 90% by weight, and in certain aspects, optionally greater than or equal to about 95% by weight of the intermetallic species present in the composition are present in the plurality of domains 32, such that these domains 32 may be considered to be rich in intermetallics, while the matrix 34 is lean in the intermetallic species or precipitates.

The matrix 34 undergoes dynamic recrystallization during the treating to form refined grains, while dynamic recrystallization in the plurality of domains 32 is minimized or prevented. For example, in certain variations, after the preform is treated by the first deforming process, a microstructure with greater than or equal to about 5% by area to less than or equal to about 50% by area, optionally greater than or equal to about 15% by area to less than or equal to about 30%, and in certain variations, about 20% by area of thermally stable grains comprising an intermetallic species is formed (or the plurality of domains 32 in FIG. 1). An area % or area fraction is measured on a cross-section of the microstructure. In certain variations, the thermally stable grains may be considered to be coarse grains in the microstructure and may have an average size of greater than or equal to about 1 μm to less than or equal to about 200 μm, optionally greater than or equal to about 20 μm to less than or equal to about 100 μm.

Figure 2:
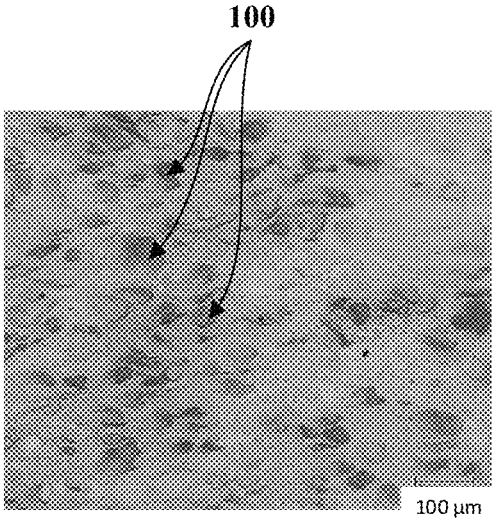
FIG. 2 shows a micrograph of a preform of a magnesium-based alloy created in accordance with certain aspects of the present disclosure including a plurality of thermally stable coarse grains distributed in a matrix of refined grains having a scale bar of 100 μm.
Figure 3:
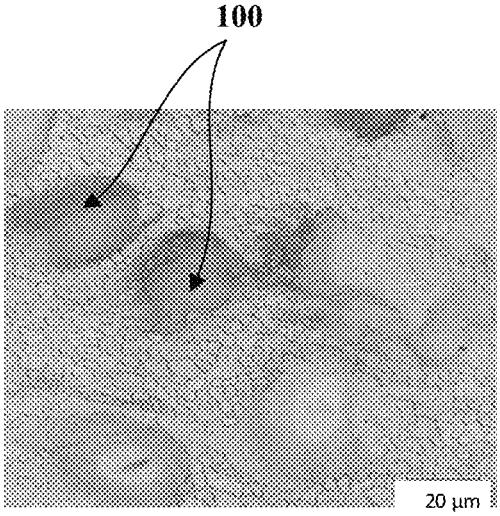
FIG. 3 shows a magnified view of the preform of the magnesium-based alloy in FIG. 4 having a scale bar of 20 μm.

During the first deforming process at low to intermediate strain rates, the regions that are external to the coarse grains and that are leaner in intermetallic species (corresponding to the matrix 34 in FIG. 1) can undergo dynamic recrystallization (DRX). However, the regions of thermally stable coarse grains (corresponding to the plurality of domains 32) are resistant to dynamic recrystallization during the first deforming process and thus are intact and not recrystallized after processing. In certain aspects, the thermally stable grains or domains may be distributed in the matrix. The dynamically recrystallized grains of the matrix may have an average size of greater than or equal to about 100 nm to less than or equal to about 20 μm, optionally greater than or equal to about 1 μm to less than or equal to about 20 μm. In various aspects, the thermally stable coarse grains may have an average grain size that is greater than or equal to 50% more than an average grain size of the dynamically recrystallized grains, optionally greater than or equal to 80%, optionally greater than or equal to 40%, optionally greater than or equal to 100%, and in certain aspects, optionally greater than or equal to 200%. Thus, as shown in FIGS. 2-3, a magnesium alloy having nominal composition of 3 wt. % zinc, 0.5 wt. % zirconium, and a balance magnesium is forged in a deformation process at a temperature of about 400° C. and has a microstructure with a plurality of thermally stable coarse grains (shown by arrows 100) defining uncrystallized domains that are homogenously distributed or embedded in a matrix of refined dynamically recrystallized grains or domains.

In certain aspects, thermally stable coarse grains defining un-recrystallized domains remain due to the formation of large amounts of refined precipitate retarding dynamic recrystallization. The softer un-recrystallized domains are easier to deform at elevated temperatures and carry much more plastic strain than the surrounding refined dynamically recrystallized grains. Therefore, strain localization induced by geometrical softening is impeded by grain size inhomogeneity. Thus, in un-recrystallized domains that remain in the preform, strain partitioning will occur at high-strain-rate deformations during subsequent processing. Furthermore, continuous dynamic recrystallization will occur at boundaries between respective domains or grains to relieve stress concentration, thus contributing to plasticity.

After treating the magnesium-based alloy to a first deforming process having a first predetermined strain rate of greater than or equal to about 0.001/s to less than or equal to about 1/s in an environment having a temperature of greater than or equal to about 250° C. to less than or equal to about 450° C. to form a preform, the methods may include subjecting the preform to a second deforming process. The second deforming process may be a high-strain process having a second predetermined strain rate of greater than or equal to about 1/s to less than or equal to about 100/s. In certain variations, the high-strain rate second deforming process is selected from the group consisting of: high-speed rolling, flow forming, and combinations thereof. The second deforming process may be conducted in an environment having a temperature of greater than or equal to about 150° C. to less than or equal to about 450° C.

In this manner, a magnesium-based alloy component is formed that is substantially free of cracking. The term "substantially free" as referred to herein means that while minor microscale cracking may occur, significant cracking defects are absent in the component after high-strain deforming to the extent that undesirable physical properties and limitations attendant with the presence of macroscale cracks are avoided (e.g., loss of strength, failure and damage, and the like). While the magnesium-based alloy components provided by the present disclosure are particularly suitable for use as components in an automobile or other vehicles (e.g., motorcycles, boats, tractors, buses, motorcycles, mobile homes, campers, and tanks), they may also be used in a variety of other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. Certain suitable automotive components formed of the magnesium-based alloy component treated in accordance with the present methods include those selected from the group consisting of: an internal combustion engine component, a valve, a piston, a turbocharger component, a rim, a wheel, a road wheel, a ring and combinations thereof.

In certain other aspects, the present disclosure also contemplates predetermining a strain rate, a strain level, and temperature and for the intermediate first deforming process via a Gleeble simulation method for obtaining a considerable portion of precipitate-rich unrecrystallized domains embedded in the crystallized grains of the matrix.

The method described above involves dynamic recrystallization of refined domains or grains that are lean in thermally stable intermetallics or precipitates that occurs during the first deforming process at relative high temperatures of greater than or equal to about 250° C. to less than or equal to about 450°. However, in certain alternative variations, static recrystallization techniques may be used, where instead of high temperature deformation at intermediate strain rates, a cold deforming process occurs. The cold deforming processes may be any of those described above, for example, including extrusion, forging, and/or rolling, except that they are conducted at relative low temperatures. In one such process, a casting comprising a magnesium-based alloy like those described previous above is treated with a cold deforming process in an environment having a temperature of less than or equal to about 200° C., optionally less than or equal to about 150° C., optionally less than or equal to about 100° C., optionally less than or equal to about 75° C., optionally less than or equal to about 50° C., and in certain variations, at room temperature, for example, between about 20° C. to about 25° C. During the cold deforming process, dislocation will accumulate in the deformed work piece.

In this method, the preform is then annealed. By annealing, it is meant that after creating the preform from the cold deforming process, the preform is heated to a temperature below its melting point. Following the annealing process, static recrystallization of the refined grains can occur, while the thermally stable coarse grains define un-recrystallized domains, similar to the bimodal microstructure described above. More specifically, annealing may include heating the preform to above a solvus temperature of the magnesium-based alloy and maintaining that temperature until the alloy elements are substantially homogeneously distributed throughout the magnesium and a solid solution is obtained. For example only, annealing may include heating the preform to a temperature greater than or equal to about 250° C. to less than or equal to about 500° C. and maintaining that temperature for a period of greater than or equal to about 1 hour to less than or equal to 6 hours. An objective of the annealing treatment is to static recrystallize the cold deformed microstructures, so that annealing time and temperature may vary to achieve this microstructure.

After the annealing, the preform is subjected to a second deforming process having a second predetermined strain rate of greater than or equal to about 1/s to less than or equal to about 100/s in an environment having a temperature of greater than or equal to about 150° C. to less than or equal to about 450° C. In this manner, a magnesium-based alloy component is formed that is substantially free of cracking.

In either of the above described methods, either involving dynamic recrystallization or static recrystallization to form a preform, prior to the initial treating to form the preform via either an intermediate strain deforming or cold deforming process, the casting may be heat treated to homogenize the magnesium-based alloy, facilitate formation of thermally-stable refined precipitates in the domains defining coarse grains, or both homogenize the magnesium-based alloy and form thermally-stable precipitates. The casting may be heated in an environment having a temperature of greater than or equal to about 250° C. to less than or equal to about 500° C. and for a period of greater than or equal to about 0.5 hours to less than or equal to 6 hours. The time and temperature for this heat treatment step may depend upon the thickness of the casting.

Furthermore, after forming the component in the second high strain rate deforming process, the magnesium-based alloy component may be aged by heating in an environment having a temperature of greater than or equal to about 150° C. to less than or equal to about 300° C. and for a period of greater than or equal to about 2 hours to less than or equal to 100 hours. In this manner, the aging can enhance mechanical properties of the magnesium-based alloy component. Again, the time and temperature for this aging step may depend upon the thickness of the casting.

Figure 4:
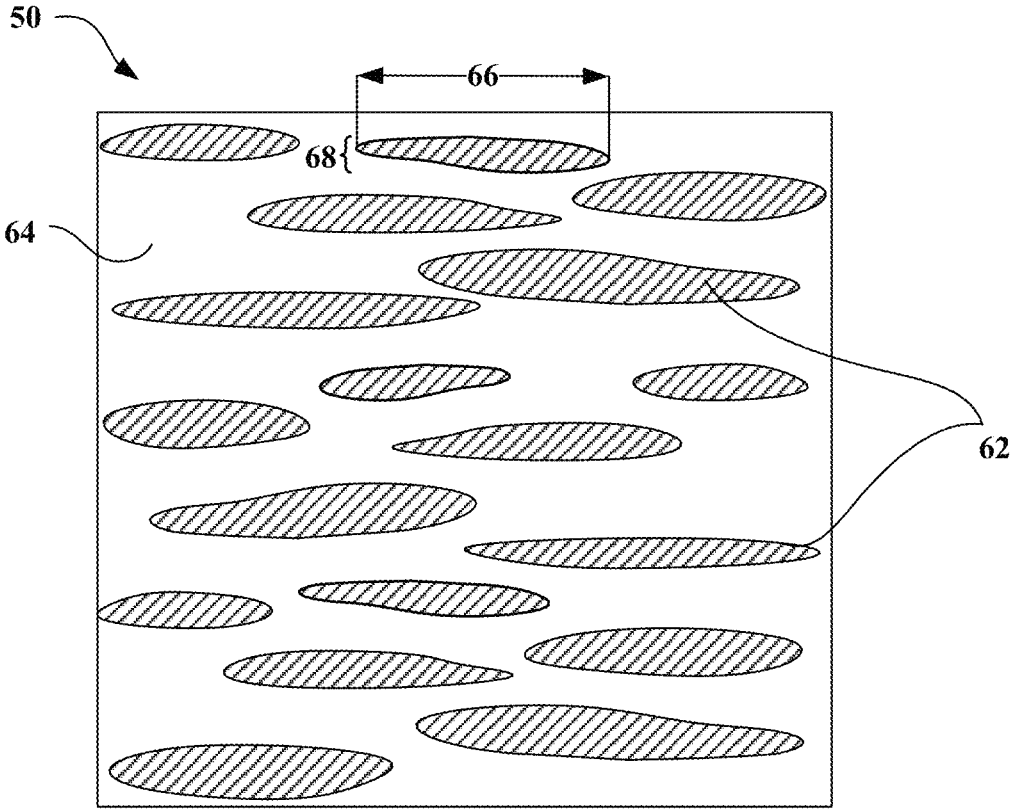
FIG. 4 shows a representative schematic of a magnesium-based alloy component after being subjected to a high strain rate process in accordance with certain aspects of the present disclosure including a plurality of elongated coarse grains distributed in a matrix of dynamically recrystallized grains.
Figure 5:
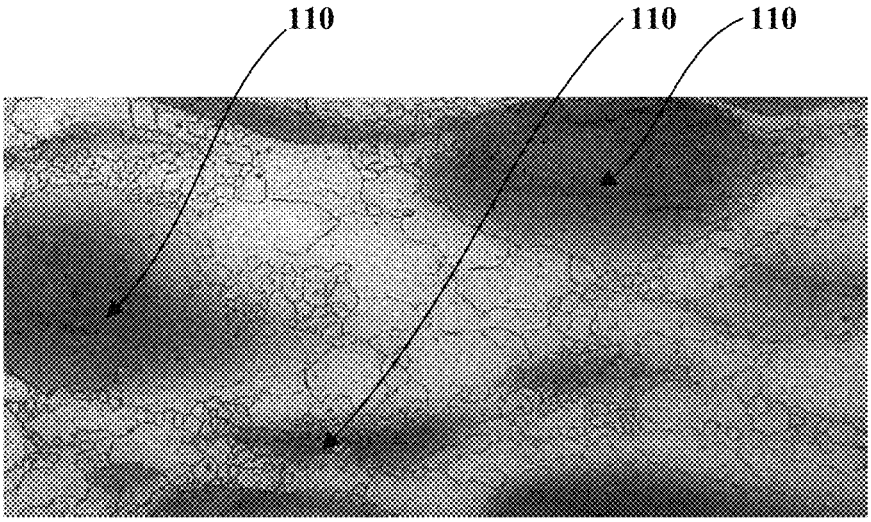
FIG. 5 shows an optical image of 50% deformed sample of a magnesium-based alloy prepared in accordance with certain aspects of the present disclosure.
Figure 6:
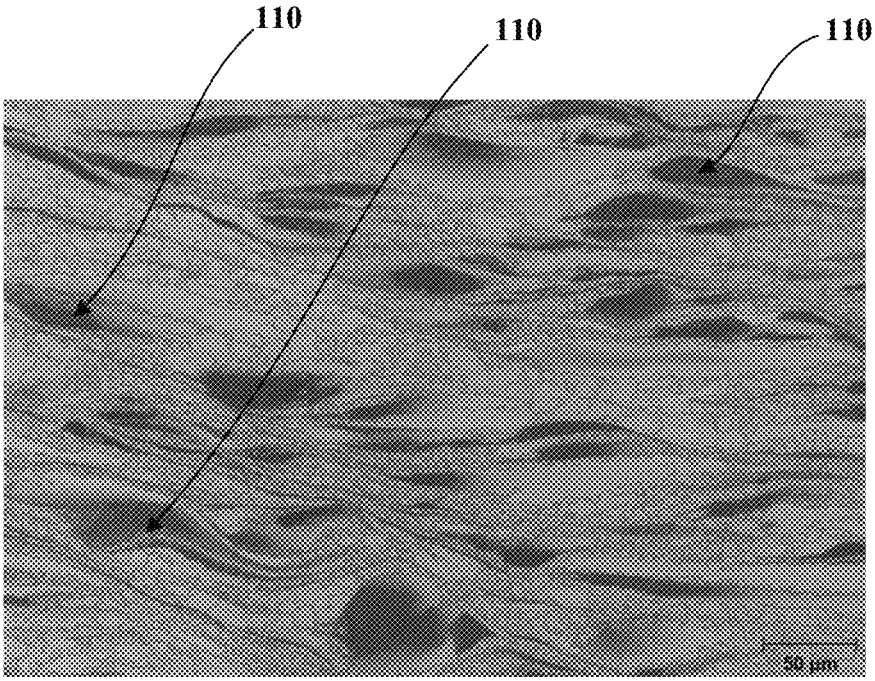
FIG. 6 shows an optical image of 67% deformed sample of a magnesium-based alloy prepared in accordance with certain aspects of the present disclosure.

In certain variations, the present disclosure also contemplates a solid magnesium-based alloy component having any of the compositions described above that comprises a new microstructure 50, such as that shown in FIG. 4, which occurs after the high-strain rate deformation process. The microstructure 50 may include a plurality of elongated thermally stable grains 62 distributed in a matrix 64 that comprises a plurality of dynamically recrystallized grains. By elongated, it is meant that each grain 62 defines a major longitudinal or elongate dimension (shown as 66 in FIG. 4), such that the grain has a prominent elongate dimension. The elongated thermally stable grains 62 may have an aspect ratio that can be defined as AR=L/W where L and W are the length (e.g., 66) and the width 68 of the grain. Desirably, the plurality of elongated thermally stable grains have an average AR of greater than about 3, optionally greater than about 5, optionally greater than about 7, and in certain variations, optionally greater than about 10. For example, as shown in FIGS. 5 and 6 show deformation of a sample having a ZK30 alloy nominally with 3 wt. % zinc, 0.5-0.6 wt. % zirconium, and a balance magnesium, after 50% and 67% deformation respectively. The aspect ratio of the coarse unrecrystallized grains (arrows 110) rich in intermetallics, like ZnZr, have an aspect ratio that is greatly changed (increased) as deformation levels increase indicating that the grains undergo a large plastic strain. The plurality of elongated thermally stable grains may have ribbon or fibrous shapes.

In certain variations, the microstructure may have greater than or equal to about 5% by area to less than or equal to about 50% by area of elongated thermally stable grains comprising an intermetallic species having an average size of greater than or equal to about 1 nm to less than or equal to about 1 μm distributed in a matrix comprising dynamically recrystallized grains having an average size of greater than or equal to about 0.1 μm to less than or equal to about 20 μm, wherein the magnesium-based alloy component is substantially free of cracking.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of making a magnesium-based alloy component comprising:

treating a casting comprising a magnesium-based alloy to a first deforming process having a first maximum predetermined strain rate of greater than or equal to about 0.001/s to less than or equal to about 1/s in an environment having a temperature of greater than or equal to about 250° C. to less than or equal to about 450° C. to form a preform, wherein the magnesium-based alloy has a composition comprising zirconium at greater than or equal to 0 to less than or equal to about 1 wt. %; manganese at greater than or equal to about 0.3 wt. % to less than or equal to about 2 wt. %; scandium at greater than or equal to 0 to less than or equal to about 15 wt. %; a rare earth metal element at greater than or equal to 0 to less than or equal to about 20 wt. %; zinc at greater than or equal to 0 to less than or equal to about 6 wt. %; aluminum at greater than or equal to 0 to less than or equal to about 3 wt. %; and a balance of magnesium, wherein the preform has a microstructure comprising a matrix comprising a plurality of crystallized grains, a plurality of thermally stable coarse grains distributed in the matrix, and one or more intermetallic species concentrated within the plurality of thermally stable coarse grains; and subjecting the preform to a second deforming process having a second maximum predetermined strain rate of greater than or equal to about 1/s to less than or equal to about 100/s in an environment having a temperature of greater than or equal to about 150° C. to less than or equal to about 450° C. to form the magnesium-based alloy component, wherein, during the second deforming process, the plurality of thermally stable coarse grains undergo plastic strain and form a plurality of elongated thermally stable grains comprising the one or more intermetallic species and distributed in the matrix.

2. The method of claim 1, wherein the one or more intermetallic species are selected from the group consisting of: ZnZr, AlMn, MnSc, AlRE, where RE is a rare earth element, and combinations thereof.

3. The method of claim 1, wherein the first deforming process is selected from the group consisting of: extrusion, forging, rolling, and combinations thereof, and wherein the second deforming process is selected from the group consisting of: rolling, flow forming, forging, ring rolling, and combinations thereof.

4. The method of claim 1, wherein prior to the treating, heat treating the casting to homogenize the magnesium-based alloy, form thermally-stable refined precipitates, or both homogenize the magnesium-based alloy and form thermally-stable refined precipitates.

5. The method of claim 1, wherein, prior to subjecting the preform to the second deforming process, an average grain size of the plurality of thermally stable coarse grains is greater than or equal to 50% more than an average grain size of the plurality of crystallized grains.

6. The method of claim 5, wherein, prior to subjecting the preform to the second deforming process, the plurality of crystallized grains have an average grain size of greater than or equal to about 0.1 μm to less than or equal to about 20 μm, and the plurality of thermally stable coarse grains have an average grain size of greater than or equal to about 1 μm to less than or equal to about 200 μm.

7. The method of claim 1, wherein the matrix undergoes dynamic recrystallization during the treating to form refined grains.

8. The method of claim 1, further comprising a heat treatment after the subjecting in an environment having a temperature of greater than or equal to about 150° C. to less than or equal to about 300° C. for a duration of greater than or equal to about 2 hours to less than or equal to about 100 hours.

9. The method of claim 1, wherein the magnesium-based alloy component is an automotive component selected from the group consisting of: an internal combustion engine component, a valve, a piston, a turbocharger component, a rim, a wheel, a ring, and combinations thereof.

10. The method of claim 1, wherein the one or more intermetallic species have an average size of greater than or equal to about 1 nanometer to less than or equal to about 1 micrometer.

11. The method of claim 1, wherein each of the plurality of elongated thermally stable grains has an aspect ratio of greater than about 3.

12. The method of claim 1, wherein the plurality of elongated thermally stable grains constitute greater than or equal to about 5% to less than or equal to about 50% of the magnesium-based alloy component.

13. The method of claim 1, wherein, by weight, greater than 50% of the one or more intermetallic species are present in the plurality of thermally stable coarse grains prior to subjecting the preform to the second deforming process.

14. A method of making a magnesium-based alloy component comprising:

treating a casting comprising a magnesium-based alloy to a cold deforming process in an environment having a temperature of less than or equal to about 200° C. to form a preform, wherein the magnesium-based alloy has a composition comprising zirconium at greater than or equal to 0 to less than or equal to about 1 wt. %; manganese at greater than or equal to about 0.3 wt. % to less than or equal to about 2 wt. %; scandium at greater than or equal to 0 to less than or equal to about 15 wt. %; a rare earth metal element at greater than or equal to 0 to less than or equal to about 20 wt. %; zinc at greater than or equal to 0 to less than or equal to about 6 wt. %; aluminum at greater than or equal to 0 to less than or equal to about 3 wt. %; and a balance of magnesium, wherein the preform has a microstructure comprising a matrix comprising a plurality of crystallized grains, a plurality of thermally stable coarse grains distributed in the matrix, and one or more intermetallic species, wherein the one or more intermetallic species are concentrated within the plurality of plurality of thermally stable coarse grains;

annealing the preform; and subjecting the preform to a second deforming process having a maximum predetermined strain rate of greater than or equal to about 1/s to less than or equal to about 100/s in an environment having a temperature of greater than or equal to about 150° C. to less than or equal to about 450° C. to form the magnesium-based alloy component, wherein, during the second deforming process, the plurality of thermally stable coarse grains undergo plastic strain and form a plurality of elongated thermally stable grains comprising the one or more intermetallic species and distributed in the matrix.

15. The method of claim 14, wherein the second deforming process is selected from the group consisting of: rolling, flow forming, forging, ring rolling, and combinations thereof.

16. The method of claim 14, wherein prior to the treating, heat treating the casting to homogenize the magnesium-based alloy, form thermally-stable refined precipitates, or both homogenize the magnesium-based alloy and form thermally-stable refined precipitates.

17. The method of claim 14, wherein the matrix undergoes static recrystallization during the treating to form refined grains.

18. The method of claim 14, further comprising a heat treatment after the subjecting in an environment having a temperature of greater than or equal to about 150° C. to less than or equal to about 300° C. for a duration of greater than or equal to about 2 hours to less than or equal to about 100 hours.

19. The method of claim 14, wherein the one or more intermetallic species are selected from the group consisting of: ZnZr, AlMn, MnSc, AlRE, where RE is a rare earth element, and combinations thereof.

20. The method of claim 14, wherein the magnesium-based alloy component is an automotive component selected from the group consisting of: an internal combustion engine component, a valve, a piston, a turbocharger component, a rim, a wheel, a ring, and combinations thereof.

* * * * *